US009289804B2

(12) United States Patent
Kim et al.

(10) Patent No.: US 9,289,804 B2
(45) Date of Patent: Mar. 22, 2016

(54) PIPE CLEANING ROBOT

(71) Applicant: GAUS Co., Ltd., Daegu-si (KR)

(72) Inventors: Young Won Kim, Daegu-si (KR); Eui Yeon Kim, Daegu-si (KR); Byong Taek Jang, Daegu-si (KR); Sung Yul Jeong, Daegu-si (KR)

(73) Assignee: GAUS Co., Ltd., Daegu-si (KR)

( * ) Notice: Subject to any disclaimer, the term of this patent is extended or adjusted under 35 U.S.C. 154(b) by 1 day.

(21) Appl. No.: 14/066,026

(22) Filed: Oct. 29, 2013

(65) Prior Publication Data

US 2014/0189968 A1 Jul. 10, 2014

(30) Foreign Application Priority Data

Jan. 4, 2013 (KR) ..... 10-2013-0001026

(51) Int. Cl.
*B08B 9/049* (2006.01)

(52) U.S. Cl.
CPC ..... *B08B 9/049* (2013.01)

(58) Field of Classification Search
CPC ..... B08B 9/027; B08B 9/04; B08B 9/049; B08B 9/0492; B08B 9/051
USPC ..... 15/104.05, 104.09, 104.16, 104.03
See application file for complete search history.

(56) References Cited

U.S. PATENT DOCUMENTS

| | | | | |
|---|---|---|---|---|
| 3,876,255 | A * | 4/1975 | Ilon | 301/5.23 |
| 4,369,713 | A * | 1/1983 | Richardson | 104/138.2 |
| 5,416,944 | A * | 5/1995 | Eriksson | 15/104.09 |
| 6,112,843 | A * | 9/2000 | Wilcox et al. | 180/345 |
| 2014/0152805 | A1 * | 6/2014 | Saeki et al. | 348/94 |

FOREIGN PATENT DOCUMENTS

| | | | | |
|---|---|---|---|---|
| JP | 2008-14447 | * | 1/2008 | F16L 55/18 |

OTHER PUBLICATIONS

Computer generated English translation of JP 2008-14447, Jan. 2008, Sugano et al.*

* cited by examiner

*Primary Examiner* — Laura C Guidotti
(74) *Attorney, Agent, or Firm* — Insight Law Group, PLLC

(57) ABSTRACT

Disclosed is a pipe cleaning robot. The pipe cleaning robot can be folded to easily enter a narrow-mouthed pipe at the initial stage, can flexibly increase or decrease in size corresponding to various diameters of pipes, and can adhere first and second transfer cars closely to the inner wall of the pipe during the transfer to prevent a rollover due to impact and vibration generated during the cleaning process.

6 Claims, 4 Drawing Sheets

PIPE CLEANING ROBOT

CROSS-REFERENCE(S) TO RELATED APPLICATION

This application claims priority of Korean Patent Application No. 10-2013-0001026, filed on Jan. 4, 2013, in the Korean Intellectual Property Office, the contents of which are incorporated herein by reference.

BACKGROUND OF THE INVENTION

1. Field of the Invention

The present invention relates to a pipe cleaning robot, and more particularly, to a pipe cleaning robot, which is folded to easily enter a narrow-mouthed pipe at the initial stage, flexibly increases or decreases in size corresponding to various diameters of pipes, and adheres closely to the inner wall of the pipe to prevent a rollover due to impact and vibration generated during the cleaning process.

2. Description of the Related Art

Generally, lines for transferring fluid, which include water and sewage pipes or cooling and heating ducts, are formed to have a necessary length by joining a plurality of pipes through welding or flange joint.

When the transfer lines are used for a long time, contaminants such as bead generated during the welding, dust, water scale, and oil scale that are introduced from the outside hinder the flow of fluid. Also, since the contamination of fluid flowing through the transfer lines increases and the purity of fluid is reduced, continuous maintenance is needed to remove the contaminants.

However, since most transfer lines have a narrow diameter or air therein is deficient to breathe but toxic gases remain, it is difficult to directly deploy a worker for the cleaning work. Thus, high-pressure fluid is allowed to sweep though the pipes, but it is difficult for this method to remove impurities tightly adhered to the inner wall of the pipe. Also, a reduction of the water pressure at a deep place inside the pipe makes it difficult to perform proper cleaning.

Thus, there is a need for a cleaning apparatus that can directly remove impurities on the inner wall while moving in the pipe. Korean Patent Application Publication No. 10-2011-0033389 discloses a pipe cleaning robot in which a support arm adhered with a brush is combined with a rotation part at the front side of a main body and cleans impurities from the inner wall while rotating.

However, since this cleaning robot includes the main body for the cleaning work and a plurality of leg parts for fixing its location in a pipe and moving, which are separately configured, and a driving unit and a controller for controlling the operation of a driving wheel and the extension and retraction of the leg part are individually needed, the structure becomes complicated, and it is not easy to miniaturize the cleaning robot. Accordingly, the cleaning robot is not proper for a transfer line including pipes with a narrow inlet or a small inner diameter.

Also, since most transfer lines include bent parts at which the direction of the transfer line is changed over about 90 degrees, the above-mentioned pipe cleaning robot without a separate direction switching unit is limited to the application to a straight line type of transfer lines due to its difficulty in changing the traveling direction.

SUMMARY OF THE INVENTION

The present invention provides a pipe cleaning robot, which is folded to easily enter a narrow-mouthed pipe at the initial stage, flexibly increases or decreases in size corresponding to various diameters of pipes, and adheres closely to the inner wall of the pipe to prevent a rollover due to impact and vibration generated during the cleaning process.

According to one aspect of the present invention, a pipe cleaning robot includes: first and second transfer cars (11, 12) including a plurality of wheels (20) individually driven and connected to each other by a hinge (13); a driving unit for controlling a folding angle between the first and second transfer cars (11, 12) around the hinge (13); and a cleaning member (30) disposed at one side of the first and second transfer cars (11, 12) to clean an inside of the pipe by a rotating force, wherein wheels disposed at one end of the first and second transfer cars (11, 12) adjacent to the hinge (13) are pressurized and supported by one inner surface of the pipe, and other wheels disposed at the other end of the first and second transfer cars (11, 12) are pressurized and supported by the other inner surface of the pipe while the pipe cleaning robot is traveling.

The pipe cleaning robot may further include a mounting groove (15) formed at one side of the first and second transfer cars (11, 12), wherein the cleaning member (30) is embedded in the mounting groove (15) and stands by when the cleaning member (30) is not used.

The first and second transfer cars (11, 12) may enter the pipe while being folded or unfolded about 180 degrees around the hinge (13).

The wheel (20) may be formed using a Mecanum wheel.

Figure 1:
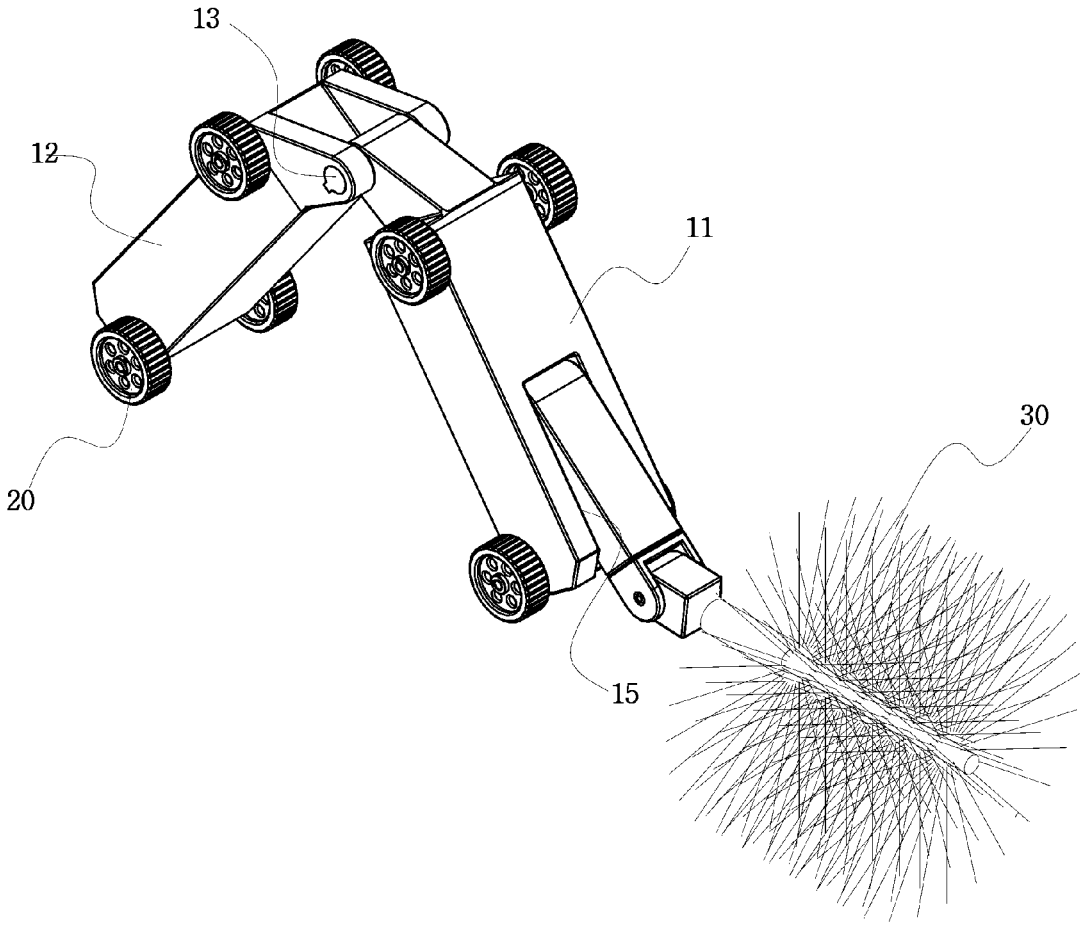
FIG. 1 is a perspective view illustrating a pipe cleaning robot according to an embodiment of the present invention.

| <Reference Numerals> | |
|---|---|
| 10: engine room | 12: engine |
| 11: first transfer car | 12: second transfer car |
| 13: hinge | 15: mounting groove |
| 20: wheel | 20a: roller |
| 30: cleaning member | P: pipe |

DETAILED DESCRIPTION OF EXEMPLARY EMBODIMENTS

Exemplary embodiments of the present invention will be described below in detail with reference to the accompanying drawings. Throughout the disclosure, like reference numerals refer to like parts throughout the drawings and embodiments of the present invention.

Hereinafter, exemplary embodiment of the present invention will be described in detail with reference to the accompanying drawings.

The present invention relates to a pipe cleaning robot, which is configured to include first and second transfer cars 11 and 12 formed in a folding type, a plurality of wheels 20, and a cleaning member 30, so as to easily enter a narrow-mouthed pipe P and adhere closely to the inner wall of the pipe P during the transfer to prevent an rollover due to impact and vibration.

FIG. 1 is a perspective view illustrating a pipe cleaning robot according to an embodiment of the present invention. The first and second transfer cars 11 and 12 may be configured such that the plurality of wheels 20 are individually driven, and may be connected to each other by a hinge 13 to allow a driving unit to control a folding angle. Although it is shown in FIG. 1 that four wheels are provided to the first and second transfer cars 11 and 12, respectively, the present invention is not limited thereto. For example, two wheels may be provided on both ends of the first and second transfer cars 11 and 12 to support the bottom surface of the pipe P, respectively, and two wheels may be provided on one side of the first and second transfer cars 11 and 22 that is adjacent to the hinge 13 to support the top surface of the pipe P.

The first and second transfer cars 11 and 12 may be transferred while the wheels 20 of the first and second transfer cars 11 and 12 adjacent to the hinge 13 are being pressurized by one side of the pipe P and the wheels 20 provided on the other end portion of the first and second transfer cars 11 and 12 are being pressurized by the other side of the pipe P. Since the first and second transfer cars 11 and 12 are transferred while the top and bottom surfaces of the pipe P are being strongly supported by the plurality of wheels 20, a rollover accident due to impact and vibration caused by the cleaning member 30 during the cleaning process can be prevented. In addition, although the wheel 20 on one side does not contact the pipe P due to the shape of the pipe P or obstacles, the wheel 20 on the other side can contact the pipe P, thereby improving the mobility of the pipe cleaning robot.

The first and second transfer cars 11 and 22 may be folded around the hinge 13, a driving unit including a motor and gears may be provided on one end of the first and second transfer cars 11 and 12 provided with the hinge 13. The driving unit may be provided such that the first and second transfer cars 11 and 12 are folded on the hinge 13 at the folding angle by a controller inside the first and second transfer cars 11 and 12 or by a controller of a wired/wireless type.

Figure 2:
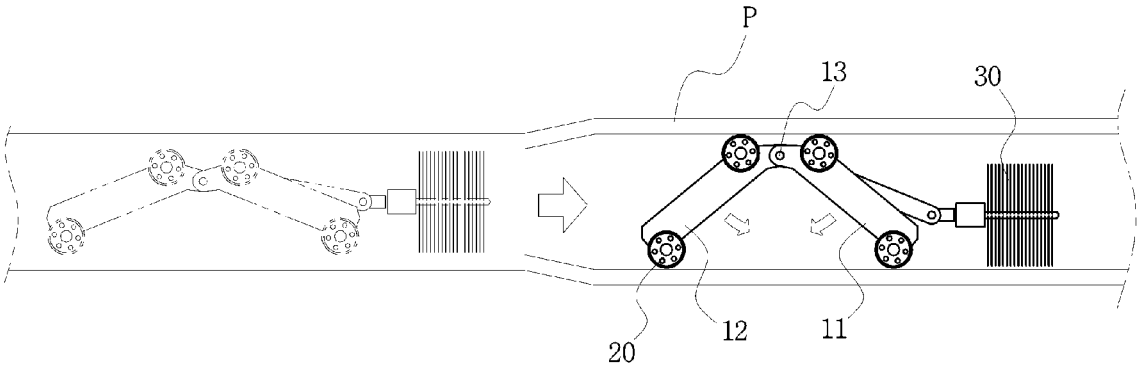
FIG. 2 is a view illustrating an operation state of a pipe cleaning robot according to an embodiment of the present invention.

Thus, as shown in FIG. 2, when the pipe cleaning robot moves from a pipe having a narrow diameter to a pipe having a wide diameter, the folding angle between the first and second transfer cars 11 and 12 may decrease and the height of the pipe cleaning robot may increase, allowing the plurality of wheels 20 to be strongly supported by the pipe having the wide diameter. On the contrary, when the pipe cleaning robot moves from a pipe having a wide diameter to a pipe having a narrow diameter, the folding angle between the first and second transfer cars 11 and 12 may increase and the height of the pipe cleaning robot may decrease, allowing the plurality of wheels 20 to be strongly supported by the pipe having the narrow diameter.

Also, the cleaning member 30 may be provided on one side of the first and second transfer cars 11 and 12 to clean the inside of the pipe P. The cleaning member 30 may be provided to move in the vertical and horizontal directions and rotate 360 degrees by a plurality of joint arms. A power unit including a motor and a striker may remove impurities from the inner wall of the pipe P. In this case, the cleaning member 30 may be replaceably mounted for rough grinding or finishing grinding according to the type and thickness of impurities. More specifically, brushes, drills, cutting blades, grinding stones, and stroke blades may be selectively used.

Figure 3:
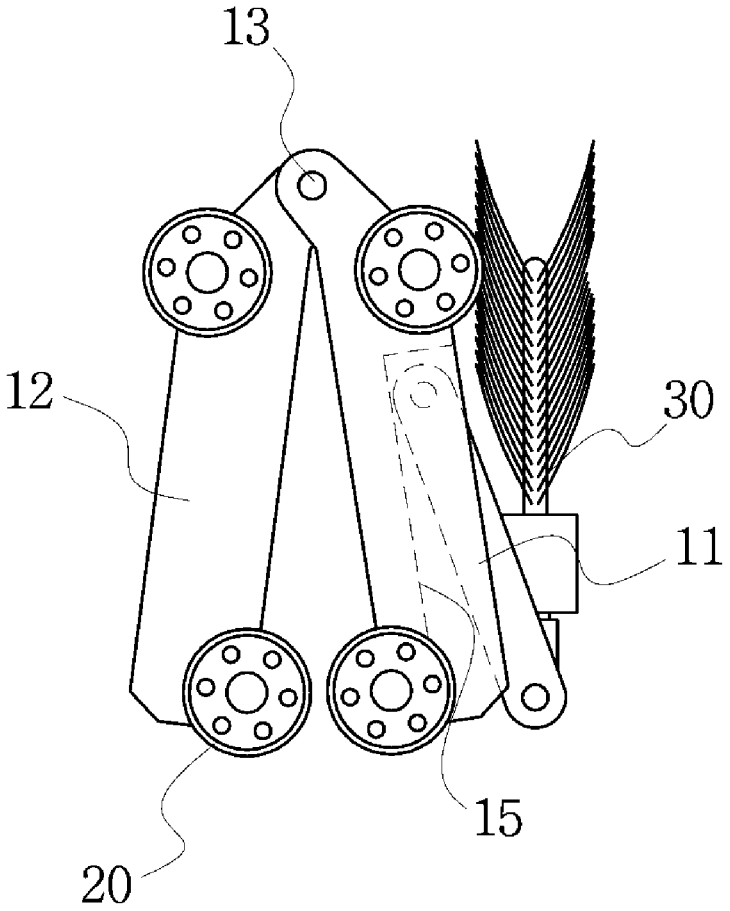
FIG. 3 is a view illustrating a pipe cleaning robot with a brush folded according to an embodiment of the present invention.

In this case, when not used, the cleaning member 30 may be embedded in a mounting groove 15 formed at one side of the first and second transfer cars 11 and 12 and may stand by. FIG. 3 illustrate the cleaning member 30 folded into the mounting groove 15. Thus, since the cleaning member 30 is stored in the mounting groove 15, the pipe cleaning robot may become compact in size and portable, thereby preventing the cleaning member 30 from being damaged when not used.

Figure 4A:
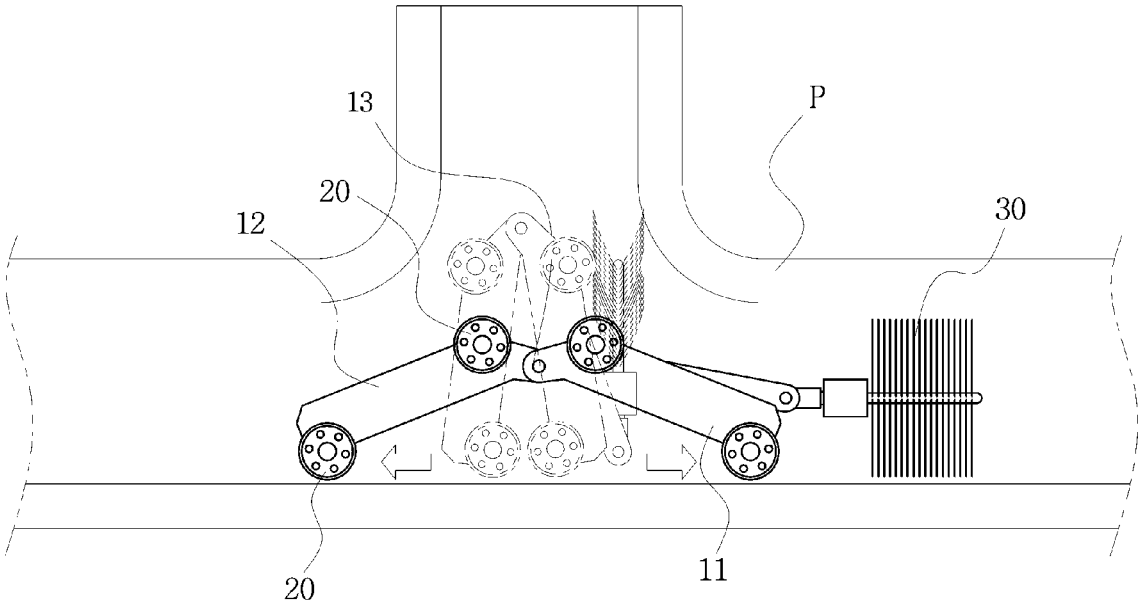
FIGS. 4A and 4B are views illustrating application examples of a pipe cleaning robot according to an embodiment of the present invention.
Figure 4B:
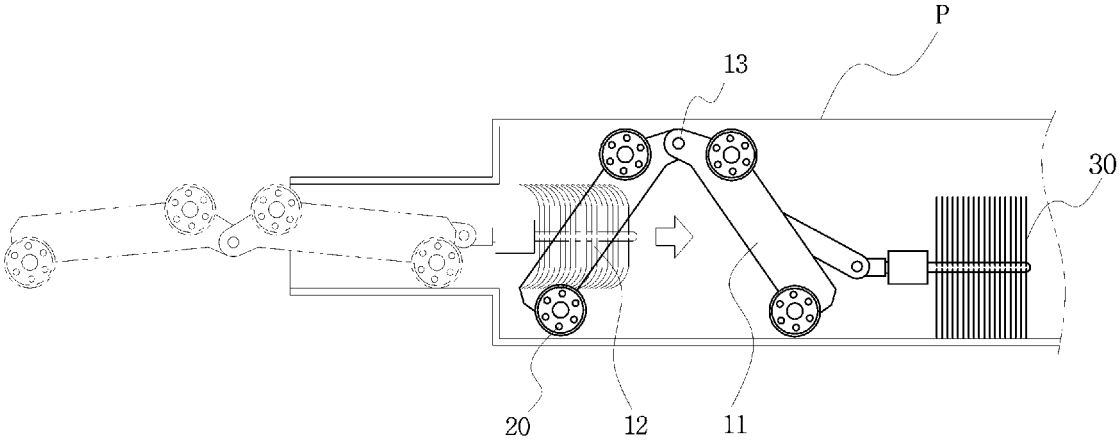

FIGS. 4A and 4B are views illustrating application examples of the pipe cleaning robot. When entering the pipe P, the first and second transfer cars 11 and 12 may be unfolded around the hinge 13 up to about 180 degrees. FIG. 4A shows that the first and second transfer cars 11 and 12 enter the pipe P having an inverted T-shape while being folded and then are unfolded in the pipe P. FIG. 4B shows that the first and second transfer cars 11 and 12 enter the pipe P having a narrow diameter while being unfolded about 180 degrees and then are folded in the pipe P.

Figure 5:
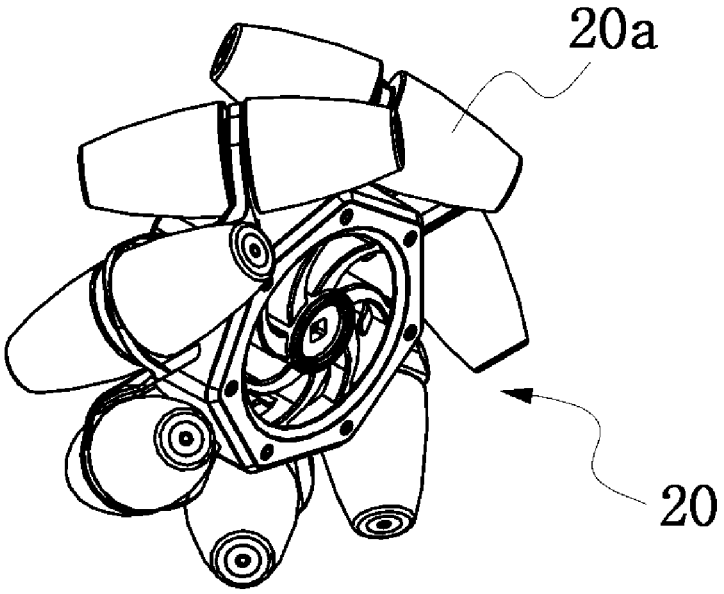
FIG. 5 is a view illustrating a Mecanum wheel applied to a pipe cleaning robot according to an embodiment of the present invention.
Figure 6:
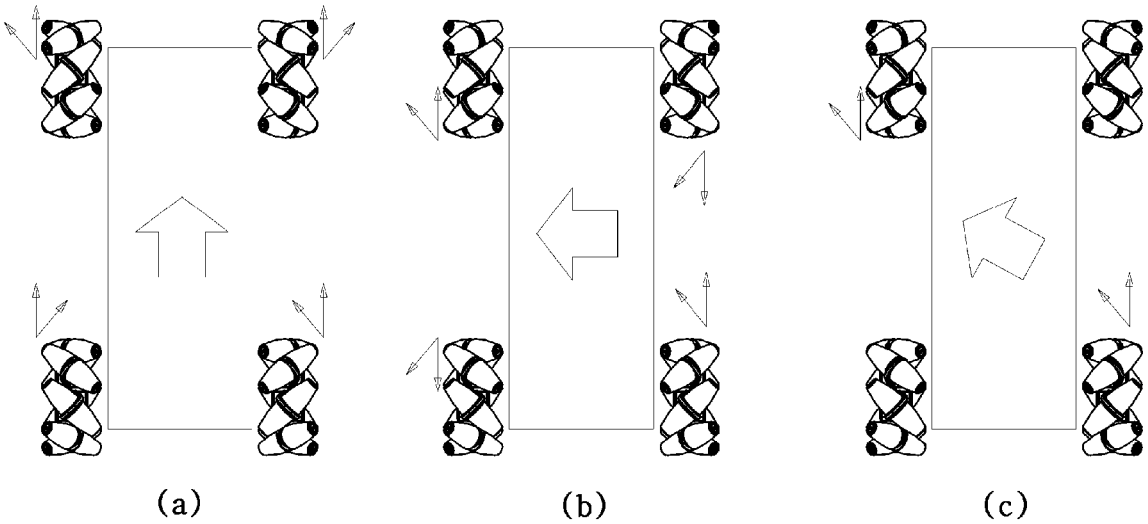
FIG. 6 is a view illustrating traveling directions according to the operation state of a Mecanum wheel applied to a pipe cleaning robot according to an embodiment of the present invention.

Also, the wheel 20 may be configured with Mecanum wheels. As shown in FIG. 5, the Mecanum wheels may be arranged obliquely to the traveling direction around the circumference of the wheel 20, and may include a plurality of rollers 20*a* that are driven separately from the wheel 20. As shown in FIG. 6, the pipe cleaning robot can rotate in place and travel in a lateral direction by combining the rotation direction of the wheel 20 and the rotation direction of the roller 20*a*, which is impossible in a typical wheel structure.

Thus, since Mecanum wheel is applied, the pipe cleaning robot can be used for general purposes regardless of the shape of the pipe P by rotating in place and traveling in a lateral direction even when the pipe P is bent in a different direction from the bent direction of the hinge 13 of the first and second transfer cars 11 and 12.

A pipe cleaning robot according to an embodiment of the present invention can be folded to easily enter a narrow-mouthed pipe at the initial stage, can flexibly increase or decrease in size corresponding to various diameters of pipes, and can adhere first and second transfer cars closely to the inner wall of the pipe during the transfer to prevent a rollover due to impact and vibration generated during the cleaning process.

While the embodiments of the present invention have been described with reference to the specific embodiments, it will be apparent to those skilled in the art that various changes and modifications may be made without departing from the spirit and scope of the invention as defined in the following claims.

What is claimed is:

1. A pipe cleaning robot comprising:

first and second transfer cars (11, 12) including a plurality of wheels (20) individually driven and connected to each other by a hinge (13);

a driving unit for controlling a folding angle between the first and second transfer cars (11, 12) around the hinge (13); and a cleaning member (30) disposed at one side of the first and second transfer cars (11, 12) to clean an inside of the pipe by a rotating force, wherein wheels disposed at one end of the first and second transfer cars (11, 12) adjacent to the hinge (13) are pressurized and supported by one inner surface of the pipe, and other wheels disposed at the other end of the first and second transfer cars (11, 12) are pressurized and supported by the other inner surface of the pipe while the pipe cleaning robot is traveling; and wherein the wheels disposed adjacent to the hinge (13) are spaced apart from a pivotal axis of the hinge (13) around which the first and second transfer cars (11, 12) are folded or unfolded.

2. The pipe cleaning robot of claim 1, further comprising a mounting groove (15) formed at one side of the first and second transfer cars (11, 12), wherein the cleaning member (30) is embedded in the mounting groove (15) and stands by when the cleaning member (30) is not used.

3. The pipe cleaning robot of claim 2, wherein the wheel (20) is formed using a Mecanum wheel.

4. The pipe cleaning robot of claim 1, wherein the first and second transfer cars (11, 12) enter the pipe while being folded or unfolded about 180 degrees around the hinge (13).

5. The pipe cleaning robot of claim 4, wherein the wheel (20) is formed using a Mecanum wheel.

6. The pipe cleaning robot of claim 1, wherein the wheel (20) is formed using a Mecanum wheel.

* * * * *